United States Patent [19]

Sieckman et al.

[11] 4,302,244

[45] Nov. 24, 1981

[54] STEEL CONVERSION METHOD

[75] Inventors: Walter Sieckman; Jai K. Pearce; Eberhard G. Schempp, all of Pittsburgh, Pa.

[73] Assignee: Pennsylvania Engineering Corporation, Pittsburgh, Pa.

[21] Appl. No.: 170,037

[22] Filed: Jul. 18, 1980

[51] Int. Cl.[3] ..... C21C 5/32; C21C 5/34

[52] U.S. Cl. ..... 75/60; 75/59

[58] Field of Search ..... 75/51, 52, 59, 60

[56] References Cited

U.S. PATENT DOCUMENTS

| | | | |
|---|---|---|---|
| 3,839,017 | 10/1974 | Schempp | 75/60 |
| 3,854,932 | 12/1974 | Bishop | 75/49 |
| 3,997,335 | 12/1976 | Kolb | 75/60 |
| 3,999,977 | 12/1976 | Kolb | 75/60 |
| 4,089,677 | 5/1978 | Spenceley | 75/51 |
| 4,178,173 | 12/1979 | Gorges | 75/52 |

*Primary Examiner*—P. D. Rosenberg
*Attorney, Agent, or Firm*—Fred Wiviott

[57] ABSTRACT

A steel conversion method includes the steps of delivering a first quantity of oxygen and a surrounding sheath of hydrocarbon shielding fluid beneath the level of a quantity of molten ferrous metal or bath contained in a vessel by means of bottom tuyeres and simultaneously delivering a second quantity of oxygen to the bath from above through a top lance. The oxygen delivered through the bottom tuyeres is sufficient to promote mixing and is about 10% to 40% of the oxygen required for oxidation of impurities with the balance delivered through the top lance. An additional quantity of oxygen is delivered through the top lance to the space above the bath for post-combustion of off-gases to increase the thermal energy in the bath. Fluxes such as lime are added from above in lump form in the conventional manner or are entrained in the upper oxygen stream as required. As the level of carbon in the bath falls toward desired levels, an inert gas is introduced through the bottom tuyeres at an increased rate while the proportion of oxygen is decreased.

13 Claims, 1 Drawing Figure

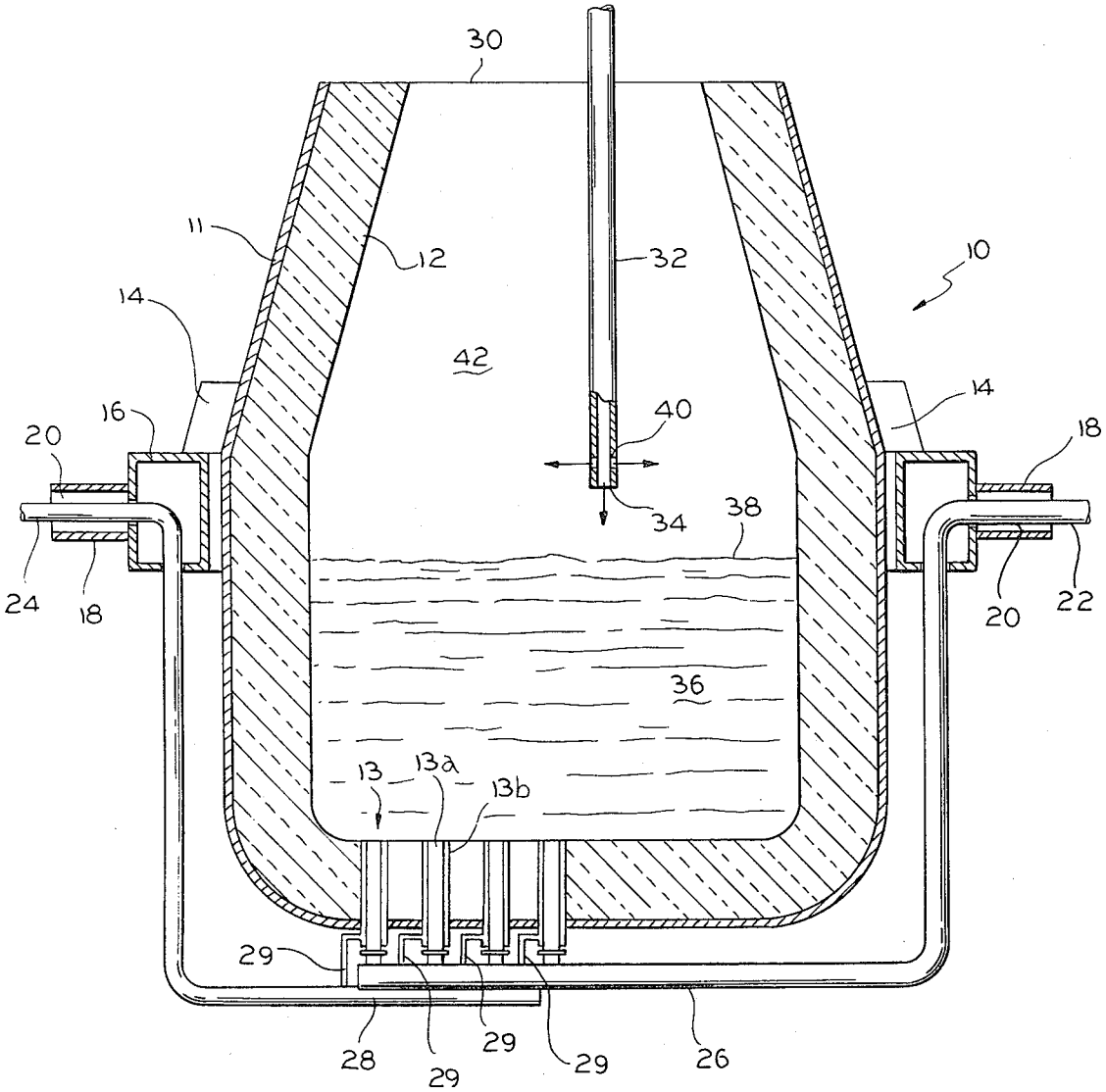
30
11
12
32
10
14
42
14
16
40
18
20
34
38
24
18
20
22
36
13
13a
13b
29
28
29
29
29
26

STEEL CONVERSION METHOD

BACKGROUND OF THE INVENTION

This invention relates to a pneumatic method of converting ferrous metal to steel.

Pneumatic methods of producing steel from scrap and hot metal generally include blowing oxygen, air or mixture of oxygen and an inert gas, such as argon, into a metallic furnace charge for oxidizing such unwanted constituents as carbon, phosphorous and silicon. The oxygen or air can be delivered by tuyeres, the inner ends of which may be submerged or above the bath level. When submerged tuyeres are employed, they may be protected by a sheath of hydrocarbon shielding fluid injected in surrounding relation to the oxygen stream. It has also been suggested that oxygen may be introduced by tuyeres above the bath for the oxidizing of combustible off-gases whereby heat is added to the furnace charge. Such top tuyeres are shown, for example, in U.S. Pat. No. 3,839,017.

While conventional top-blown systems are satisfactory for the production of ordinary low-carbon steels, they are not wholly satisfactory. For example, bath mixing in the top-blown process is relatively poor in comparison to bottom blown systems. As a result, the iron content of the slag tends to be relatively high, that is, in the range of 15 to 30%. Such slags tend to foam resulting in considerable furnace slop and loss of iron from the system. As a result of these and other disadvantages, there have been attempts to convert top-blown systems into submerged tuyere furnaces.

One method for converting a top-blown metallurgical vessel to one having submerged tuyeres is discussed in U.S. Pat. No. 3,810,297 wherein conversion involves removing the furnace bottom and substituting a new bottom containing a plurality of two-pipe tuyeres. The inner pipes of such tuyeres are connected for delivering an oxygen stream to the molten metal bath while a concentric outer pipe is provided for delivering hydrocarbon shielding fluid. Also, the trunnion pins of such vessels are drilled for receiving oxygen and shielding fluid supply pipes which are connected to the respective tuyere pipes by connecting manifolds. As those skilled in the art will appreciate, it is also necessary in steel conversion methods to provide fluxing agents, such as lime, to the bath for desulfurization and phosphorous removal. This material is commonly entrained in the oxygen stream so that in bottom tuyere systems a lime distributor must be mounted on the lower end of the vessel so that the powdered material may be provided to each of the tuyeres. As a result of these process requirements, together with lime grinding, storage and injection equipment, conversion of a top-blown to a bottom-blown furnace is relatively expensive.

SUMMARY OF THE INVENTION

It is an object of the invention to provide a new and improved steelmaking method.

A further object of the invention is to provide a steelmaking method which permits the conversion of top-blown to bottom-blown operation without the provision of additional costly lime handling systems.

A further object of the invention is to provide a pneumatic steelmaking process in which the iron content of the slag is lower than in conventional top-blown methods.

Yet another object of the invention is to provide a steelmaking method wherein the loss of iron as a result of slopping is minimized.

These and other objects and advantages of the present invention will become more apparent from the detailed description thereof taken with the accompanying drawing.

BRIEF DESCRIPTION OF THE DRAWING

The single FIGURE of the drawing schematically illustrates a metallurgical vessel in which the method of the invention may be practiced.

DESCRIPTION OF THE PREFERRED EMBODIMENT

The method of the invention may be carried out in the vessel 10 shown in the drawing, although those skilled in the art will appreciate that it is exemplary. The vessel 10 is generally pear-shaped in vertical section and includes a metallic shell 11 and a refractory lining 12. A plurality of tuyeres 13 extend through the lower end of the vessel and each includes an inner pipe 13*a* and a concentric outer pipe 13*b* spaced from the inner pipe to permit the injection of oxygen and a surrounding sheath of hydrocarbon shielding fluid as will be discussed more fully below. Converter vessels of the type illustrated are generally supported in a conventional manner by means of a plurality of peripherally spaced-apart brackets 14 which engage and are releaseably secured to a hollow trunnion ring 16 surrounding the vessel 10. Trunnion pins 18 extend from each of the opposite sides of ring 16 and are suitably supported in a well-known manner on conventional bearing structures (not shown) and one is coupled to a suitable drive mechanism (not shown) for tilting the vessel to each of a plurality of positions as may be required during a process cycle.

The trunnion pins 18 may each have a hollow bore 22 for respectively receiving a gas delivery pipe 22 and a hydrocarbon shielding fluid delivery pipe 24. Additional pipes (not shown) may also be provided for delivering cooling water to the hollow trunnion ring 16 and other areas of the vessel, and in particular those portions adjacent its upper end. Pipe 22 is connected at its lower end to a first manifold 26 which in turn is connected to each of the central tuyere pipes 13*a*. Similarly, pipe 24 is connected at its lower end to manifold pipe 28 which in turn is connected by short feeder pipes 29 to the gap between tuyere pipes 13*a* and 13*b*. For a more detailed description of the manner of passing pipes 22 and 24 through trunnion pins 16 and 18 and of connecting the same tuyeres 13, reference is made to U.S. Pat. No. 3,810,297.

The vessel 10 has an opening 30 at its upper end for receiving an oxygen lance 32. Disposed at the lower end of lance 32 is a nozzle 34 or a plurality of nozzles for projecting oxygen downwardly toward the furnace charge 36 and the slag layer 38 on its upper surface. In addition, sidewardly directed orifices 40 may be provided in lance 32 for projecting oxygen into the space 42 above the surface of slag layer 38. Lance 32 may otherwise be conventional and may be suitably cooled in any well known manner.

In practicing the method of the invention, the vessel 10 is first charged with scrap metal and/or hot metal. If scrap metal is used so that preheating is required, oxygen and a hydrocarbon shielding fluid are delivered to the inner and outer tuyere pipes 13 and 13*b*; respectively, of the lower tuyeres 13 which acts as a burner.

Preheating is continued until the scrap has been heated to the required temperature. After preheating has been completed, the vessel may be charged with hot metal. After completion of the charging operation, the lance 32 is lowered through the vessel opening 30 and the oxygen blow is commenced using oxygen from top and bottom.

During the simultaneous top and bottom flow, fluxes such as lime, are added in a conventional manner either by additions in lump form dropped through the vessel opening 10 or entrained in powdered form with the gas blown through the top lance 32.

During this main blow with simultaneous top and bottom blowing operations, oxygen and/or a combination of oxygen and inert gas or inert gas alone is delivered to the central tuyere pipe 13*a* and a hydrocarbon shielding fluid, such as propane, natural gas or light oil, for example, is delivered to the outer tuyere pipe 13*b*. The oxygen will reduce the carbon, silicon and phosphorous levels of the bath 36 by oxidation. The relative portions of oxygen delivered to the bath through tuyeres 13 is about 10% to 40% of the total oxygen required for reduction with the balance being delivered by the lance 32.

The injection of oxygen and/or inert gas or a mixture thereof through the lower tuyeres 13 promotes stirring so that relatively good mixing is achieved between the bath 36 and the slag 38. As a result, good oxidation of the metalloids is achieved without the creation of a foamy slag which tends to cause slopping. The iron content by weight in the slag is in the range of 5% to 20% as opposed to a 15% to 30% range which occurs in purely top-blown processes. This reduction in the iron level of the slag tends to reduce the total thermal energy transferred to the system. This loss is offset by the introduction of oxygen into the area above the bath 36 through the orifices 40 of lance 32 for the oxidation of off-gases emanating from the surface of the bath 36. As those skilled in the art will appreciate, during the main oxygen blow, these gases will principally comprise hydrogen and carbon monoxide as a result of the oxidation of carbon in the bath 36 and the disassociation of the hydrocarbon shielding fluid. The oxidation of these gases above the bath will provide the thermal energy required to maintain the thermal balance in the furnace and would provide additional thermal energy to melt additional scrap over and above that melted conventionally in purely top-blown operations or bottom-blown operations.

Typically, pig iron will contain about 3–4% carbon which is reduced by oxidation to about 0.02–0.8%, depending on the type of steel being produced. As the carbon level in the bath 36 falls toward the preselected level, argon may be injected with the oxygen through the central tuyere pipes 13*a*. This would commence at a level of about 30% argon and 70% oxygen. The ratio of argon to oxygen is continually increased until the oxygen is completely replaced by argon in both tuyere pipes 13*a* and 13*b*. This results in the purging of dissolved nitrogen and hydrogen from the bath 36 and also continues mixing the bath to enhance carbon oxidation while the delivery of oxygen continues through the top lance 32. After the completion of the main oxygen blow, the lance 32 may be removed, but gas must still be delivered to the lower tuyere pipes 13 to prevent the backflow of molten metal. This can take the form of oxygen and hydrocarbon shielding fluid in the inner and outer tuyeres respectively, or inert gas, such as argon or nitrogen, in both tuyere pipes. The use of inert gas purging as an after-blow will further enhance the removal of carbon. Sulphur and phosphorous to meet special metallurgical requirements in the production of ultra-low carbon steels below 0.02%C.

In conventional methods of converting top-blown vessels to bottom-blown systems, such as that discussed in U.S. Pat. No. 3,810,297, it is necessary to remove and replace the entire vessel bottom because of the number of tuyeres required and because of the need for a lime distribution system. When the process of the present invention is employed, however, it is not necessary to replace the entire bottom. Rather, the relatively fewer tuyeres which are required can be installed through holes drilled in the vessel bottom. Also, because a lance is used, the lime distribution system of the original top blow vessel may be utilized. As a result, conversion can be relatively less costly.

While only a single embodiment of the invention has been illustrated and described, it is not intended to be limited thereby but only by the scope of the appended claims.

We claim:

1. A method of converting ferrous metal contained in a vessel to steel comprising the steps of:

injecting a first quantity of oxygen into said metal and through one or more tuyeres beneath the surface thereof for oxidizing a first portion of the carbon in said metal, injecting a hydrocarbon shielding fluid in surrounding relation to said oxygen, simultaneously injecting a second quantity of oxygen into said metal from a top lance disposed above said metal and extending through a top opening in said vessel, said second quantity of oxygen oxidizing a second portion of the carbon in said metal, continuing the injection of oxygen through said tuyeres and said lance until the level of carbon in said metal has been reduced to the desired limits.

2. The method set forth in claim 1 wherein 5% to 50% of the oxygen required for carbon reduction is delivered through the tuyeres and 95% to 50% is delivered through the top lance.

3. The method set forth in claim 1 wherein at least a portion of the total fluxing agent required is entrained in powdered form in the oxygen delivered through the top lance.

4. The method set forth in claims 1, 2 or 3 wherein oxygen is injected into said vessel above said metal simultaneously with the injection of oxygen into said metal for oxidizing off-gases from said metal.

5. The method set forth in claim 3 wherein said fluxing agent is lime.

6. The method set forth in claim 1 and including the step of injecting argon with said oxygen through said tuyeres as the level of carbon in said metal is reduced and increasing the ratio of argon to oxygen as the level of carbon is further reduced.

7. The method set forth in claim 6 wherein 5% to 50% of the oxygen required for carbon reduction is delivered through the tuyeres and 95% to 50% is delivered through the top lance.

8. The method set forth in claim 6 wherein at least a portion of the total fluxing agent required is entrained in powdered form in the oxygen delivered through the top lance.

9. The method set forth in claims 7 or 8 wherein oxygen is injected into said vessel above said metal simultaneously with the injection of oxygen into said metal for oxidizing off-gases from said metal.

10. A method of reducing the carbon level in a quantity of molten ferrous metal contained in a vessel, said vessel having bottom tuyeres located below the expected level of metal in said vessel and a top lance insertable through an opening in said vessel to a position above said metal level, the steps comprising:

injecting through said tuyeres and into said metal a first portion of the oxygen required to reduce the carbon level in said metal to a preselected value, simultaneously delivering downwardly to said metal and from said lance the remaining portion of the oxygen required to reduce the carbon level in said metal to said preselected level, and terminating the delivery of said oxygen when the carbon level in said metal is reduced to said preselected level.

11. The method set forth in claim 10 wherein 5% to 50% of the oxygen required for the reduction of carbon to said level is delivered through the tuyeres and 95% to 50% is delivered through the top lance.

12. The method set forth in claim 11 wherein a fluxing agent is entrained in powdered form in the oxygen delivered through the top lance.

13. The method set forth in claim 12 wherein oxygen is injected into said vessel through said lance and above said metal simultaneously with the injection of oxygen into said metal for oxidizing off-gases from said metal.

* * * * *